United States Patent [19]

Brooks

[11] Patent Number: 4,791,412

[45] Date of Patent: Dec. 13, 1988

[54] MAGNETIC ARTICLE SURVEILLANCE SYSTEM AND METHOD

[75] Inventor: Roger Brooks, North Palm Beach, Fla.

[73] Assignee: Controlled Information Corporation, Lake Park, Fla.

[21] Appl. No.: 149,579

[22] Filed: Jan. 28, 1988

[51] Int. Cl.[4] ..... G08B 13/18

[52] U.S. Cl. ..... 340/572; 340/551; 340/568; 342/442

[58] Field of Search ..... 340/551, 552, 568, 572, 340/571, 825.54; 342/394, 395, 442; 455/60

[56] References Cited

U.S. PATENT DOCUMENTS 4,249,167 2/1981 Purenton et al. ..... 340/551

4,622,542 11/1986 Weaver ..... 340/551

*Primary Examiner*—Herbert Goldstein

*Assistant Examiner*—Anh H. Tran

*Attorney, Agent, or Firm*—Steele, Gould & Fried

[57] ABSTRACT

A surveillance system based upon generation and detection of phase shifted harmonic signals from markers on articles or persons, responsive to transmission of a reference signal at a fundamental frequency in a detection zone, may be adversely affected by the presence in the detection zone of large metal objects, such as shopping carts. Such objects can alter the phase of the harmonic signals from predetermined values. An alternate signal processing technique for such a surveillance system recognizes that immunity to such disturbances can be achieved by measuring the phase between two or more of the harmonic signals returned from the marker, because the effect of such large metal objects has been found to have the same effect on all of the harmonic signals. Correspondence to a predetermined phase difference is a reliable indicator of marker detection.

7 Claims, 1 Drawing Sheet

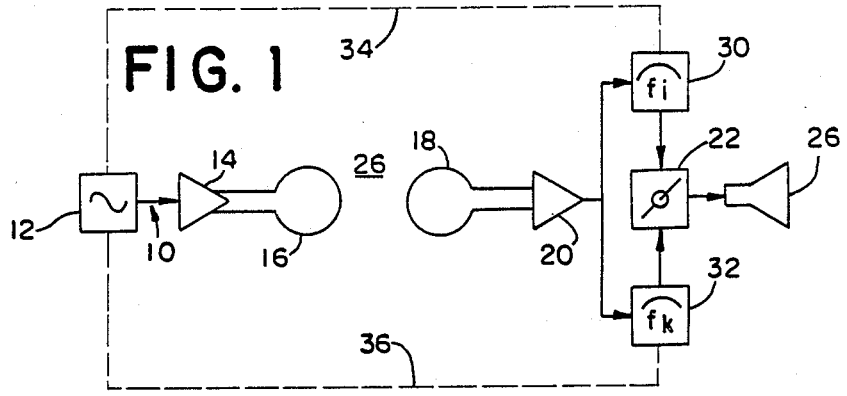
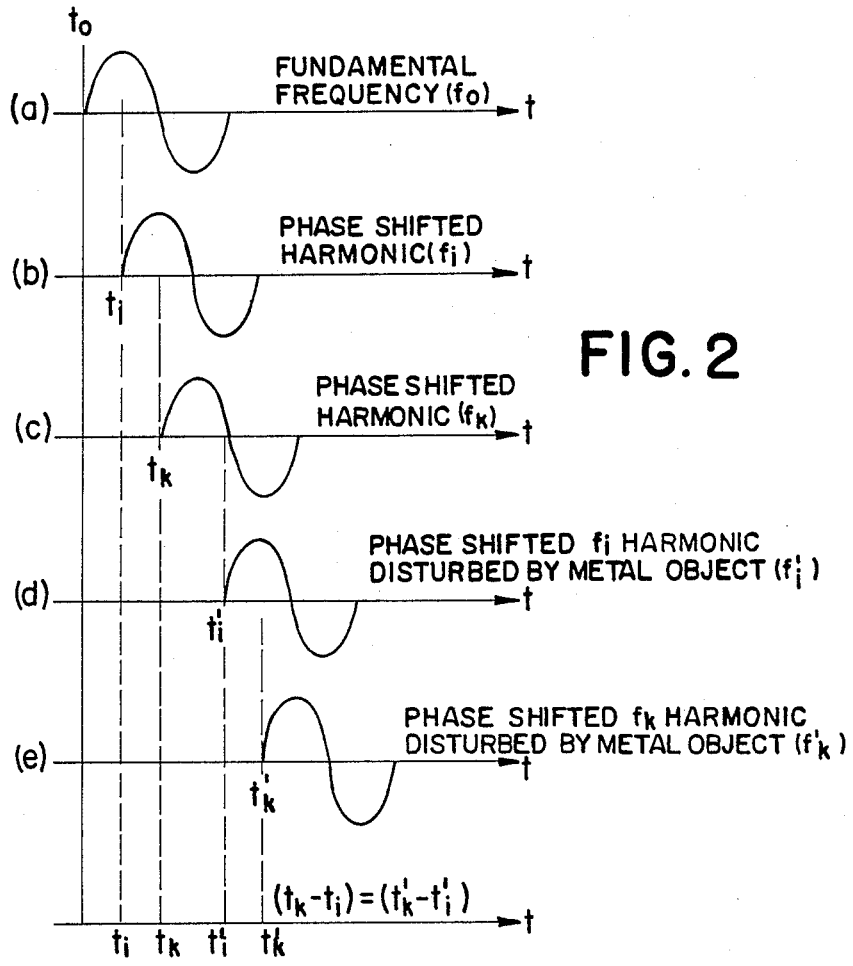
FIG. 2

MAGNETIC ARTICLE SURVEILLANCE SYSTEM AND METHOD

BACKGROUND OF THE INVENTION

1. Field of the Invention

The invention relates to magnetic article surveillance systems in general, and in particular, to harmonic phase comparison signal processing for such systems.

2. Statement of Art

Article surveillance systems using soft magnetic materials and low frequency detection systems have been known since the Picard patent (763,861) was issued in France in 1934. Picard discovered that when a piece of metal is subjected to a sinusoidally varying magnetic field, an induced voltage, characteristic of the metal composition, is produced in a pair of balanced coils in the vicinity of the applied field. Today, such systems utilize the harmonics produced by a marker of soft magnetic strip to detect the marker. Due to the nonlinear characteristics of such markers, groups of even and odd order harmonics can be produced simultaneously or individually. Odd order (1, 3, 5 . . . ) harmonics are produced by a symmetrical switching of the B/H loop. Even order harmonics (2, 4, 6 . . . ) are produced by a non-symmetrical switching condition, typically caused by a D.C. magnetic bias internal or external to the material.

The nonlinear characteristics of the soft magnetic material, while not commonly found, can be duplicated in some ferrous alloys by the presence of a magnetic bias. This results in the generation of even and odd order harmonics that duplicates the response of soft magnetic materials, such as Permalloy and the metallic glass products. However, the use of more sensitive detection equipment can add to the probability of false alarms due to ferrous alloys. More sensitive detection equipment also increases the difficulty of effectively deactivating markers, that is, turning markers "off".

Another limitation of the soft strip and low frequency system is that only a single bit of information is available during marker and system interaction. The marker is either in the detection zone, or not. The only other alternative is that the marker is, whether or not in the detection zone, deactivated. While this is not a disadvantage for systems used in theft control, it is an extreme limitation when used for monitoring the flow of a group of differing objects, or even persons, through the detection zone.

Those systems using coded devices for monitoring people and articles in a selected area are quite capable of a large number of codes. Card access systems are a good example. They generally combine a digital network and/or radio frequency circuit to transmit the code. However these devices are too expensive to use either for theft control of low cost items or for inventory control in factories or stores. It is understood that encoded markers can be affixed to or otherwise carried by any article or person, animal, etc. The term "article" is used herein to encompass such possibilities.

A magnetic article surveillance system disclosed in U.S. Pat. No. 4,622,542 differed from the prior art in that the codes utilized are not duplicated by biased ferrous alloys, even accidentally. Further, the coded marker can be embodied in a single element device and can be programmed (code changed) by altering the geometry of or extent of a conductor surrounding a magnetic core. It is detectable at large distances and is not sensitive to spatial orientation within the system. Article surveillance is based upon the detection of phase shifted harmonics generated by markers in a detection zone. The number of codes does not depend on the marker structure but on the phase resolution of the detection system and programming device.

Such a system, based upon phase shifted harmonics, has already lent itself to an improved system for reliably deactivating magnetic markers, which system is taught in commonly owned, copending application Ser. No. 052,240. As the prior art is explained therein, prior art markers utilizing a single strip of soft magnetic material can be deactivated by placing one or more elements of a high coercivity material along the length of the single strip. A magnetic bias applied to and retained by the high coercivity material reduces the harmonic generation of the single, soft magnetic strip. This technique is often unreliable, and usually is ineffective when the marker encounters the high field intensity of the transmitter and a closely coupled, highly sensitive receiver. Such a technique is also particularly ineffective for preventing false alarms due to the presence of multiple deactivated tags. The deactivation technique of such prior art systems is such that the harmonic signal generated by the soft magnetic material is normally not completely eliminated. Assuming, for example, that a system is effective to reduce the amplitude of the harmonic signal to ten percent (10%) of its normal level, then a consumer carrying ten deactivated tags on ten legitimately purchased articles will likely set off an alarm due to the cumulative amplitudes of the ten damped harmonic signals.

However, the ability to control harmonic phase permits the generation of signals having a unique signature, apart from both ferrous alloys and soft magnetic materials. This avoids the accidental detections plaguing prior art systems as described above. In addition, a number of codes can be established according to the phase shift induced. The phase shift is not affected by a low level, external magnetic bias, in that odd order products are totally unaffected and even products shift by $+1 -180$ degrees.

In accordance with the teachings of U.S. Pat. No. 4,622,542, a conductive material surrounding a soft magnetic material is responsible for a predetermined phase shift of the harmonic signal generated by the marker in a surveillance or detection zone. A second ferromagnetic element, of higher coercivity than the core material, may be placed over the conductive material. Whenever the higher coercivity magnetic material is itself magnetized by an external magnetic field, the higher coercivity magnetic material has the effect of shutting off that portion of the marker (i.e., the core) so that the harmonic signal is not affected by the conductive material. In effect, the core becomes blind to the presence of the conductive material and the harmonic signal is not phase shifted by the predetermined amount necessary to constitute an alarm condition. Accordingly, the problem of false alarms due to the presence of multiple deactivated tags is eliminated altogether, as the reduced phase shifts of deactivated tags are not cumulative. For example, ten harmonic signals, each of which is shifted by only ten degrees, rather than for example by 100 degrees, will not appear to be cumulatively shifted by 100 degrees.

Development of such deactivatable coded markers brought to light a potential difficulty with multiply coded markers. The phase of odd order marker generated harmonics is dependant upon the saturation characteristics of the soft magnetic material, and the saturation characteristic changes somewhat as the field intensity of the transmitted signal varies. In other words, when a coded marker enters a detection zone, the intensity of the transmitted electromagnetic field tends to vary. The variation in intensity causes the phase of the odd harmonics to shift to some degree. This does not present a problem for basic kinds of markers coded only for on or off theft detection systems, but eventually causes a problem when high resolution is needed in order to decode relatively small phase shifts. It has been discovered that this problem can be solved by incorporating into an article surveillance system, operating on phase shifted harmonics, means for automatically adjusting the transmitted reference signals responsive to a characteristic of the received harmonic signals, for example the intensity, to compensate for the variation due to marker presence in the detection zone and thereby prevent the random variation in the phase shift of the harmonic signals.

Further development of phase detection based systems has also revealed that, under certain circumstances, the phase shift between the signal generated by the phase-locked oscillator (of the transmitting circuit) and the detected harmonic(s) may be affected by the presence in the surveillance zone of large metal objects, such as shopping carts. Such objects can alter the phase of the magnetic flux coupling the transmitter to a surveillance tag and can also effect the phase of the currents produced in the coils of the antenna in the receiving circuit by the tag. The invention of this application is based upon the recognition that immunity to these disturbances can be achieved by measuring the phase between two or more of the harmonic signals returned from the tag, because the effect of such large metal objects in the surveillance zone has been found to be the same on all of the harmonic signals. If a predetermined phase shift from the fundamental frequency $f_0$ to a first harmonic frequency $f_1$ is a° and from the fundamental frequency $f_0$ to a second harmonic frequency $f_2$ is b°; and $f_1$ and $f_2$ are shifted randomly but equally by a large metal object in the surveillance zone, then the phase difference (a°−b°; or, b°−a°) between $f_1$ and $f_2$ is a reliable indicator of marker detection.

The use of a harmonic characteristic difference calculation in a surveillance system for a different purpose is disclosed in U.S. Pat. No. 4,489,313 - Pfister. A directional loop antenna array is provided by two flat parallel spaced apart open loops with a shorted turn disposed between the open loops equidistant therefrom. The signals from the open loops are vectorially added and subtracted in a sum and difference circuit and the phase angle between the sum and difference signals is ascertained in a phase detector circuit that feeds an indicator. The so determined phase angle is either greater or less than 90° depending upon the relative magnitudes of the loop signals. Such an arrangement provides an output indicative of the direction to a source of AC signals, and in particular, from an identification tag passing through a portal interrogating station. The system enables a determination to be made as to which direction the tag is travelling through the portal. Except for the singular case where the signal originates from a point lying in the plane that is equidistant from, parallel to, and between the planes of the loops, the signal amplitude induced in the loops will be unequal. It is this in equality that is utilized to determine on which side of the loops the source is located. The signal inequality arises as a consequence of the attenuation of a signal with distance of travel. There is nothing in the Pfister system which suggests the phase determination for detecting a marker as utilized in the present invention, not withstanding the use of a phase measurement.

Reference may be made herein to theories and principles which are more fully explained in patents and other applications commonly owned with this application. Accordingly, the teachings of U.S. Pat. No. 4,622,542, U.S. Pat. No. 4,675,657 and application Ser. No. 052,240 are fully incorporated herein by reference.

SUMMARY OF THE INVENTION

It is an object of this invention to provide an article surveillance system utilizing encoded magnetic markers adapted to be carried by articles or persons to be monitored in a detection zone.

It is another object of this invention to provide a method for monitoring articles or persons carrying encoded magnetic markers in a detection zone.

It is still another object of this invention to provide methods and apparatus for an article surveillance system utilizing encoded magnetic markers, with improved signal processing.

It is yet another object of this invention to provide methods and apparatus for article surveillance systems utilizing encoded magnetic markers, which article surveillance systems are immune from disturbances caused by the presence of large metal objects and the like in the detection zone.

It is still another object of this invention to provide methods and apparatus for article surveillance systems utilizing encoded magnetic markers, which article surveillance systems are immune to malfunctions caused by the presence of shopping carts and the like in a detection zone.

It is still another object of this invention to provide methods and apparatus for article surveillance systems utilizing encoded magnetic markers, based upon signal processing of phase shifted harmonics of a phase locked reference signal of a fundamental frequency.

These and other objects are accomplished by a magnetic article surveillance system, comprising: means for generating and transmitting reference signals at a fundamental frequency in a detection zone; a plurality of coded markers, each marker having means for generating phase shifted harmonic signals responsive to the reference signals at the fundamental frequency; means for receiving the phase shifted harmonic signals generated by coded markers in the detection zone; means for determining the relative phase shift between at least two of the harmonic marker signals; and, means for generating a control signal responsive to identification of a valid code by the determining means. In a theft determining system, for example, the surveillance system may further comprise means for comparing a predetermined relative phase shift between two harmonic signals, for enabling a yes/no detection signal to be generated by the control signal generating means. In an inventory control system, for example, the surveillance system may further comprise: means for precisely measuring the degree of relative phase; and, means for generating a variable control signal corresponding to the measured degree of relative phase shift. Each of the markers comprises means for adjusting the degree of phase shift of the harmonic signals. In particular, each of the markers may comprise a core of soft magnetic material at least partly surrounded by an electrically conductive material, the degree of phase shift being proportional to the amount and thickness of the electrically conductive material, relative to the amount of core material, to the configuration of the electrically conductive material and to the resistivity of the electrically conductive material.

These and other objects are also accomplished by a method for conducting surveillance of articles or persons in a detection zone, comprising the steps of: providing each article or person with a coded marker having means for generating phase shifted harmonic signals responsive and relative to reference signals; transmitting phase locked reference signals at a fundamental frequency into the detection zone; receiving phase shifted harmonic signals generated by each marker in the detection zone responsive to the reference signals; and, measuring the phase shift between at least two of the harmonic marker signals, the degree of the phase shift being related to positive identification of a marker in the detection zone. In a theft detection system, for example, the method may further comprise the step of generating a control signal responsive to identification of a coded marker in the detection zone. In an inventory control system, for example, the method may further comprise the steps of: forming each of the markers from a core of soft magnetic material surrounded by an electrically conductive material; encoding the markers with different codes; and, generating a variable control signal corresponding to the measured degree of phase shift between the detected harmonic signals. The markers can be variably encoded by adjusting at least one of the amount of and/or thickness of the electrically conductive material relative to the amount of core material; the configuration of the electrically conductive material; and, choosing the electrically conductive material according to its characteristic resistivity. The degree of phase shift is proportional to each of the amount, the configuration and the resistivity.

BRIEF DESCRIPTION OF THE DRAWINGS

Presently preferred embodiments of the invention are shown in the drawings, being understood, however, that the invention is not limited to the precise arrangements and instrumentalities shown.

FIG. 1 is a block diagram of a theft control surveillance system according to this invention; and, FIG. 2 is a diagramatical presentation showing two harmonic signals shifted in phase relative to a reference signal at a fundamental frequency.

DETAILED DESCRIPTION OF THE PREFERRED EMBODIMENTS

An article surveillance system 10 according to this invention is shown in block diagram form in FIG. 1. For purposes of simplicity, the system illustrated is a theft detection system rather than, for example, an inventory control system. The oscillator 12 generates signals which are phase locked to one another and which are exact multiples of the fundamental frequency being transmitted. The fundamental frequency signal is relatively free of harmonic distortion. The fundamental signal is applied to the transmitter/amplifier 14 where it is amplified. The amplified signal is coupled to the transmitter antenna 16, which is composed of one or more turns of copper wire, and transmitted into a detection zone 26. The resultant transmitted signal is preferably a substantially pure sine wave of electromagnetic energy and is within a preferred frequency range of 100 Hz to 10,000 Hz.

The receiver antenna 18, also disposed in detection zone 26, is composed of one or more turns of copper wire and is coupled to a receiver/amplifier 20. The receiver/amplifier 20 amplifies all received signals, and outputs same to at least two harmonic signal filters 30 and 32. Harmonic signal filters 30 and 32 are designated as $f_i$ and $f_k$, and are indicative of any two harmonic signals of the fundamental frequency. Each such harmonic filter is operable to select only one harmonic of the transmitted fundamental frequency from the received signals. The output of each filter is preferably a substantially pure sign wave at the desired frequency, $f_i$ or $f_k$. Such filters are well known in the art and need not be described herein in detail. Nevertheless, reference is made to a technique described as discrete time filtering, which provides the necessary selectivity, and which is described in some detail in U.S. Pat. No. 4,309,697, the pertinent aspects of which are incorporated herein by reference. Such discrete time filtering techniques require a time base, which can be provided by oscillator 12. Clock signals may be transmitted to filters 30 and 32 by signal lines 34 and 36 respectively, which are shown in FIG. 1 by dashed lines, as the technique is only one of many which is available. The use of high pass, band pass and low pass filters, as well as commutating filters in the context of an article surveillance system is also described in U.S. Pat. No. 4,675,657, already incorporated herein by reference.

The harmonic signals $f_i$ and $f_k$ are coupled to the phase comparator 22 which measures and verifies correct phase relationship between the two harmonic signals. When the system is used for theft detection, a correct phase correlation between harmonic signals will cause the phase comparator 22 to produce an output to the alarm indicator 28. The alarm may be an audible or visual signal or a combination of both.

For the sake of simplicity, only two harmonic filters have been shown and the comparison of the relative phase shift of only two received harmonic signals has been illustrated. However, it will be apparent to those skilled in the art that more than two harmonic signals may be extracted from the received signal, and that the respective phases thereof may be compared as is required to increase the level of confidence in the validity of a detected alarm condition.

When the system is used for monitoring access or inventory, markers effecting different degrees of phase shift between harmonic signals will pass through the detection zone of the system. The signals generated by each marker will have a different phase orientation to the reference signal, and to each other. This difference will be detected by the phase comparator, and depending upon the application information, may be transferred to a cash register, computer, electro-mechanical actuator or any combination of these.

A representation of the phase shifts (delays) of marker harmonics when a conductor encloses a soft magnetic material is shown in FIG. 2. A phase shift of almost any value can be produced from 0 degrees through 360 degrees. The only limiting factor is that the greater the shift, the greater the attenuation of the amplitude of the harmonic produced by the markers.

FIG. 2 is a timing diagram having five base lines (a) through (e). FIG. 2 illustrates one wave of a fundamental frequency $f_o$ beginning at $t_0$. In the absence of large metal objects in the detection zone, a phase shift coded magnetic marker will generate a plurality of signals harmonically related to the fundamental frequency. One such harmonic shown in base line (b) is designated $f_i$, begins at time $t_i$, and is delayed in phase relative to the fundamental frequency by a time delay$=t_i-t_o$. A second harmonic signal is shown on base line (c) and designated $f_k$, beginning at time $t_k$ and being delayed in phase relative to the fundamental frequency $f_0$ by time delay$=t_k-t_o$. The phase shift between the fundamental frequency $f_o$ and each of the harmonic signals $f_i$ and $f_k$ is predetermined, and in the absence of disturbing influences in the detection zone, is constant. Accordingly, the difference in phase between the harmonic signals, which is equal to $t_k-t_i$, is also constant. This predetermined and characteristic phase difference can be measured as an indicator of a valid alarm condition, that is, that an active coded marker is in the detection zone.

Base lines (d) and (e) illustrate the effect of large metal objects in the detection zone, such as shopping carts, at the time an active valid marker is in detection zone. Harmonic signal $f_i$ begins at time $t'_i$, being delayed by a time delay$=t'_i-t_o$. Similarly, harmonic signal $f_k$ begins at time $t'_k$, being delayed in phase by a time delay$=t'_k-t_o$. If determining means were employed solely for the purpose of measuring a phase shift relative to the transmitted fundamental frequency, the presence of the large metal object in the detection zone might prevent detection of a valid alarm condition, because the predetermined phase shift tested for by the determining means would not be satisfied. However, continuing research has revealed that the disruptive influence of the large metal object, in the form of a further phase shift than would otherwise be predetermined, affects each of the harmonic signals equally. Accordingly, the phase difference $t_k-t_i$ is equal to the phase difference $t'_k-t'_i$. The difference is therefore a reliably characteristic difference, which can be predetermined and tested for irrespective of whether or not metal objects of varying size are present in the detection zone.

The particulars of the phase locked oscillator, transmitter, receiver, antennas, phase comparator and downstream control equipment (alarms, cash registers computers, etc.) are well known in the art. The dimensions of and choices among appropriate materials for the markers are capable of virtually infinite variation within the general scope of the invention, namely the generation and detection of phase shifted harmonics. The number of codes possible is theoretically infinite, but is of course limited by practical engineering constraints and system and component tolerances and costs.

This invention may be embodied in other specific forms without departing from the spirit or essential attributes thereof. Accordingly, reference should be made to the appended claims, rather than the foregoing specification, as indicating the scope of the invention.

What is claimed is:

1. An article surveillance system, comprising:

means for generating and transmitting reference signals at a fundamental frequency in a detection zone;

a plurality of coded markers, each marker having means for generating harmonic signals of respective and predetermined phase shifts responsive to the reference signals;

means for receiving the phase shifted harmonic signals generated by coded markers in the detection zone;

means for determining the relative phase shift between at least two of the harmonic marker signals; and, means for generating a control signal responsive to identification of a valid code by the determining means.

2. The surveillance system of claim 1, comprising means for comparing a determined relative phase shift between at least two harmonic signals to a predetermined phase shift, for enabling a yes/no detection signal to be generated by the control signal generating means.

3. The surveillance system of claim 1, comprising:

means for precisely measuring the degree of relative phase shift; and, means for generating a variable control signal corresponding to the measured degree of relative phase shift.

4. The surveillance system of claim 1, wherein each of the markers comprises means for adjusting the degree of phase shift at the harmonic signals.

5. A method for conducting surveillance of articles in a detection zone, comprising the steps of:

providing each article with a coded marker having means for generating harmonic signals of predetermined phase shifts responsive and relative to reference signals;

transmitting reference signals at a fundamental frequency into the detection zone;

receiving phase shifted harmonic signals generated by each marker in the detection zone responsive to the reference signals; and, measuring the phase shift between at least two of the harmonic marker signals, the degree of the phase shift difference being related to positive identification of a marker in the detection zone.

6. The method of claim 5, further comprising the step of generating a control signal responsive to identification of a coded marker in the detection zone.

7. The method of claim 5, comprising the step of generating a variable control signal corresponding to the measured degree of phase shift difference.

* * * * *